US005486801A

United States Patent [19]

Leupold

[11] Patent Number: 5,486,801

[45] Date of Patent: Jan. 23, 1996

[54] SPHERICAL MAGNET STRUCTURE FOR USE IN SYNCHROTRON RADIATION SOURCE

[75] Inventor: Herbert A. Leupold, Eatontown, N.J.

[73] Assignee: The United States of America as represented by the Secretary of the Army, Washington, D.C.

[21] Appl. No.: 349,221

[22] Filed: Dec. 5, 1994

[51] Int. Cl.[6] ..... H01F 7/02

[52] U.S. Cl. ..... 335/306; 315/503; 335/210

[58] Field of Search ..... 335/210, 302, 335/306; 315/5.35, 500–505

[56] References Cited

U.S. PATENT DOCUMENTS

| | | | |
|---|---|---|---|
| 4,837,542 | 6/1989 | Leupold | 335/306 |
| 5,028,903 | 7/1991 | Aubert | 335/306 |
| 5,072,204 | 12/1991 | Leupold | 335/306 |
| 5,103,200 | 4/1992 | Leupold | 335/217 |
| 5,216,401 | 6/1993 | Leupold | 335/306 |
| 5,382,936 | 1/1995 | Leupold et al. | 335/306 |

*Primary Examiner*—Leo P. Picard
*Assistant Examiner*—Raymond M. Barrera
*Attorney, Agent, or Firm*—Michael Zelenka; John M. O'Meara

[57] ABSTRACT

Within a magnetic structure, passages are incorporated equatorially about a spherical magnet for entering and exiting a cavity therein. To enhance the density of the field in the cavity, magnetic material other than that of the spherical magnet is incorporated within the magnet structure. A source of synchrotron radiation is derived by combining the magnet structure with means for introducing charge particles through the passages to the cavity wherein the magnetic field influences the particles to travel in a circular path.

6 Claims, 2 Drawing Sheets

SPHERICAL MAGNET STRUCTURE FOR USE IN SYNCHROTRON RADIATION SOURCE

GOVERNMENT INTEREST

The invention described herein may be manufactured, used, and licensed by or for the United States Government for governmental purposes without payment to me of any royalties thereon.

BACKGROUND OF THE INVENTION

The present invention relates generally to spherical magnet structures and more particularly to such structures for use in synchrotron radiation sources.

Synchrotron radiation is generated by directing charged particles in a circular path. Magnet arrangements for generating synchrotron radiation are well known. However such arrangements include a plurality of separately mounted magnets and therefore, tend to be of cumbersome construction.

SUMMARY OF THE INVENTION

It is the general object of the present invention to provide a spherical magnet structure having passage means disposed equatorially thereabout for entering and exiting a cavity through which a magnetic field passes.

It is one specific object of the present invention to enhance the magnetic field density within the cavity of the magnet structure to which the general object relates.

It is another specific object of the present invention to incorporate the magnet structure of the general object into a synchrotron radiation source.

These and other objectives are accomplished in accordance with the present invention by modifying the magnet structure of U.S. Pat. No. 4,837,542 with passage means for entering and exiting the cavity thereof. The enhanced magnetic field density is attained by incorporating materials such as iron, about the cavity in the modified magnet structure. In the synchrotron radiation source, charged particles are directed into that cavity through the passage means and influenced therein to travel a circular path, with the synchrotron radiation resulting from those, particles being emitted from the cavity through the passage means.

The scope of the present invention is only limited by the appended claims for which support is predicated on the preferred embodiments hereinafter set forth in the following description and the attached drawings wherein like reference characters relate to like parts throughout the several figures.

DESCRIPTION OF THE PREFERRED EMBODIMENTS

Figure 1:
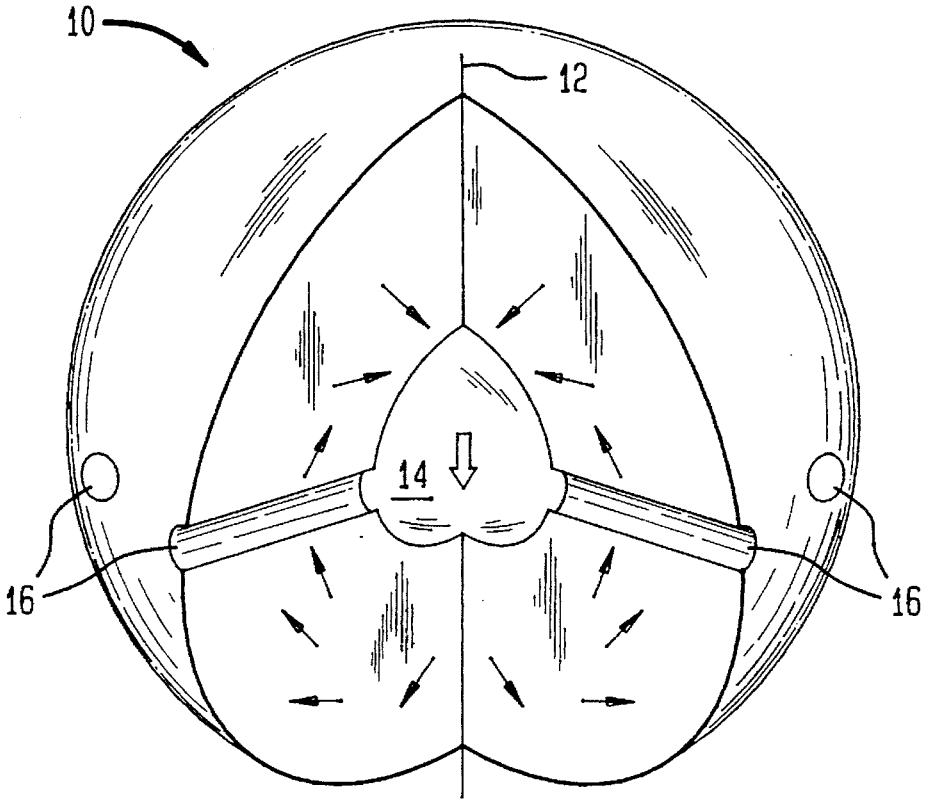
FIG. 1 is a cutaway, isometric view regarding the fundamental magnet structure of the invention.

Of fundamental importance to the present invention is a magnet structure 10 of spherical configuration that has poles through which a magnetic axis 12 passes as shown in FIG. 1. Magnet structure 10 includes a cavity 14 which is centrally disposed therein. Although the cavity 14 is of spherical configuration in FIG. 1, other configurations thereof are possible, such as the substantially cylindrical configuration shown in FIG. 3. Passage means 16, such as apertures, for entering and exiting the cavity 14 is disposed equatorially about the structure 10. The cavity 14 could also be configured to include a peripheral opening through the magnet structure 10, which would serve as the passage means 16. With this cavity configuration, the magnet structure 10, sustains a magnetic field in one direction along the magnetic axis 12 and in the opposite direction across the peripheral opening. Of course, either direction of this magnetic field could be utilized in applications, such as in a synchrotron radiation source.

Although it is not yet practical to fabricate or magnetize spherical magnet structures of single piece construction, segmented construction of such structures in accordance with the concepts disclosed in U.S. Pat. No. 5,337,472 is readily achievable. Regardless of its construction technique, structure 10 is fabricated of permanently magnetic material which is magnetized to pass a magnetic field through the cavity 14 in directions parallel to the magnetic axis 12. Therefore, the introduction of charged particles into the cavity 14 will result in those particles being influenced by the magnetic field, to travel in a circular path around the magnetic axis 12. As is well known, charged particles traveling in a circular path generate synchrotron radiation and consequently, the magnet structure 10 of this invention can be utilized in implementing a source of such radiation.

Figure 2:
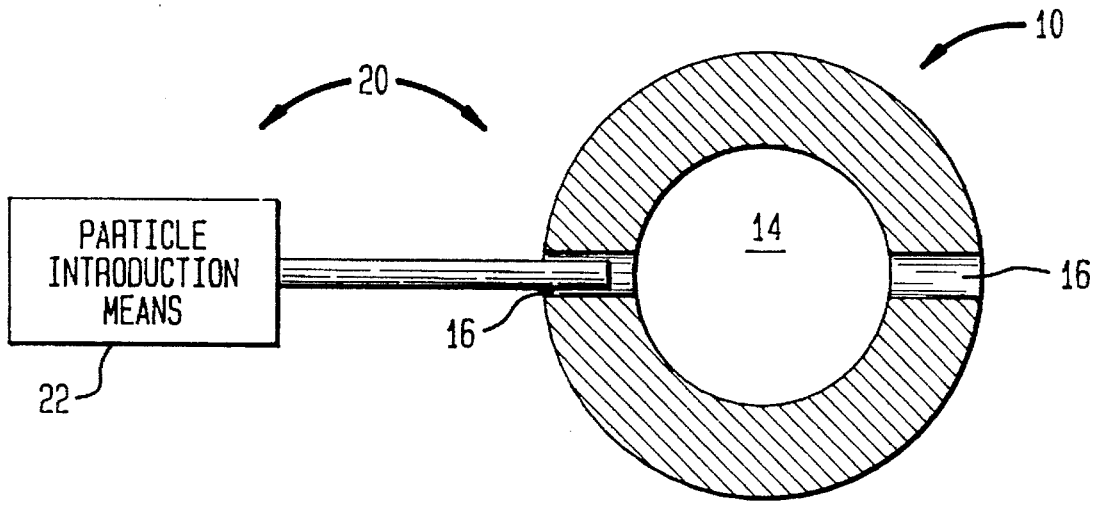
FIG. 2 is a block diagram of a synchrotron radiation source in accordance with the invention.

A synchrotron radiation source 20 with the magnet structure 10 of the invention incorporated therein, is illustrated in FIG. 2. Means 22 is disposed in proximity to the magnet structure 10 for introducing charged particles through the passage means 16 thereof, to a plane oriented perpendicularly across the magnetic axis 12 within the cavity 14 thereof. A conventional electron gun could serve as the particle introduction means 22 and as explained above, such particles travel in a circular path about the magnetic axis 12. Therefore, synchrotron radiation is generated by those particles and is emitted out of the cavity 14 through the passage means 16.

Figure 3:
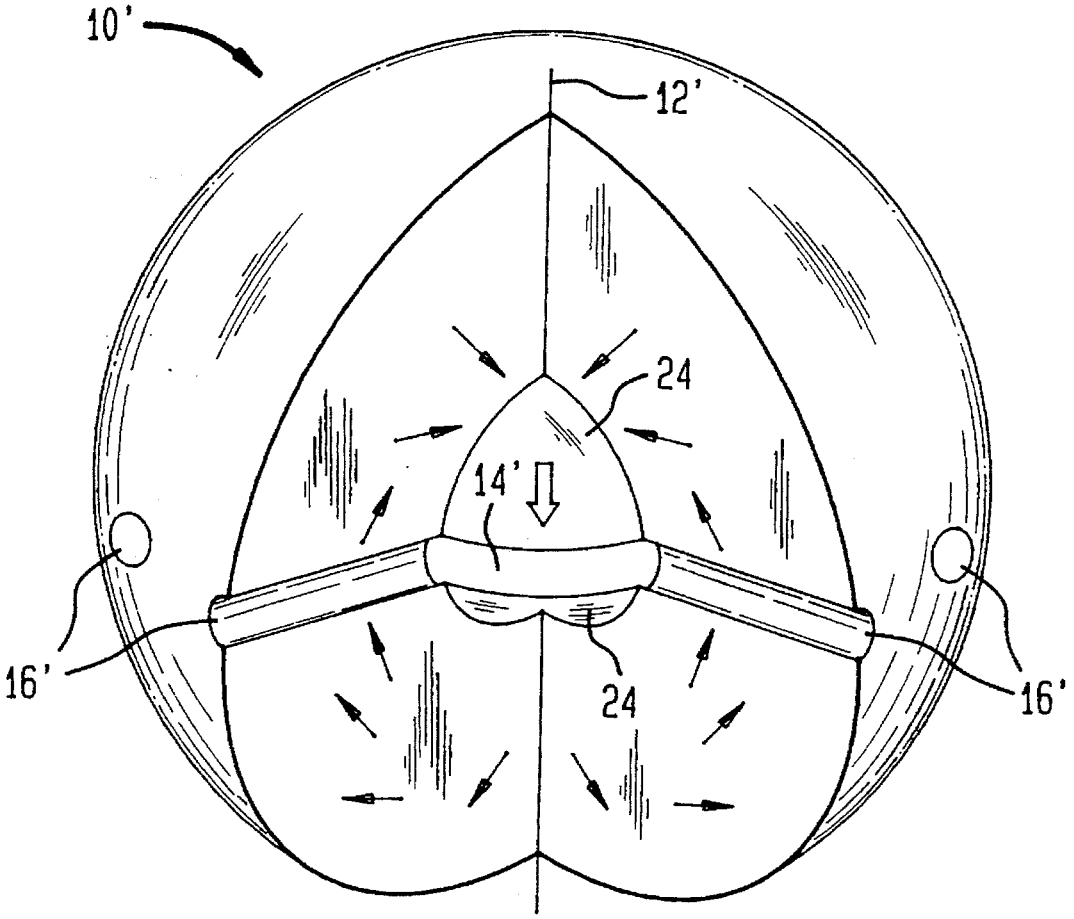
FIG. 3 is a cutaway, isometric view regarding a particular magnet structure embodiment of the invention.

As shown in the magnet structure 10' of FIG. 3, a second magnetic material 24 may be incorporated therein to enhance the magnetic field density within the cavity 14'. In this embodiment of the invention, the second magnetic material 24 is symmetrically configured about the axis 12' on both sides of the cavity 14' to focus the magnetic field thereabout. The second magnetic material 24 may be either active (permanently magnetic) or passive such as iron. Although the cylindrical configuration of cavity 14' is suitable for use of the magnet structure 10' in a synchrotron radiation source 20', it may be varied in accordance with other design objectives.

Those skilled in the art will appreciate without any further explanation that within the concept of this invention, many modifications and variations are possible to the above disclosed embodiments of spherical magnet structures. Consequently, it should be understood that all such modifications and variations fall within the scope of the following claims.

What I claim is:

1. A source of synchrotron radiation, comprising:

a sphere fabricated of permanently magnetic material with a cavity centrally disposed therein and passage means disposed equatorially thereabout for entering and exiting the cavity, the sphere being magnetized to pass a magnetic field through the cavity in parallel with a magnetic axis which extends between poles thereon; and means for introducing charged particles through the passage means to a plane oriented perpendicularly across the magnetic axis within the cavity wherein such particles are influenced by the magnetic field to travel in a circular path around the magnetic axis and thereby generate synchrotron radiation which emits from the cavity through the passage means.

2. The radiation source of claim 1 wherein the passage means is a plurality of apertures.

3. The radiation source of claim 1 wherein a second magnetic material is incorporated in the sphere to enhancebe the magnetic field density within the cavity.

4. The radiation source of claim 3 wherein the second magnetic material is symmetrically configured about the magnetic axis on both sides of the cavity to focus the magnetic field about that axis.

5. The radiation source of claim 3 wherein the second magnetic material is an active type other than that from which the sphere is fabricated.

6. The radiation source of claim 3 wherein the second magnetic material is a passive type.

* * * * *